United States Patent [19]

Rapp

[11] 4,357,980

[45] Nov. 9, 1982

[54] VENETIAN BLIND

[76] Inventor: Clifton Rapp, Box 12, S-340 15 Vittaryd, Sweden

[21] Appl. No.: 190,076

[22] Filed: Sep. 23, 1980

[51] Int. Cl.[3] ..... E06B 9/30; E06B 9/26

[52] U.S. Cl. ..... 160/168 R; 160/176 R

[58] Field of Search ..... 160/168, 168 A, 173, 160/174, 176

[56] References Cited

U.S. PATENT DOCUMENTS 2,759,535 8/1956 Berglind ..... 160/168

3,294,153 12/1966 Fountain ..... 160/168

FOREIGN PATENT DOCUMENTS 221982 5/1910 Fed. Rep. of Germany ... 160/168 A

*Primary Examiner*—Price C. Faw, Jr.
*Assistant Examiner*—Cherney S. Lieberman
*Attorney, Agent, or Firm*—Albert L. Jeffers; John F. Hoffman

[57] ABSTRACT

A venetian blind having a lift cord which through a linkage in the blind head controls an operating element for tilting the slats.

10 Claims, 5 Drawing Figures

VENETIAN BLIND

Figure 1:
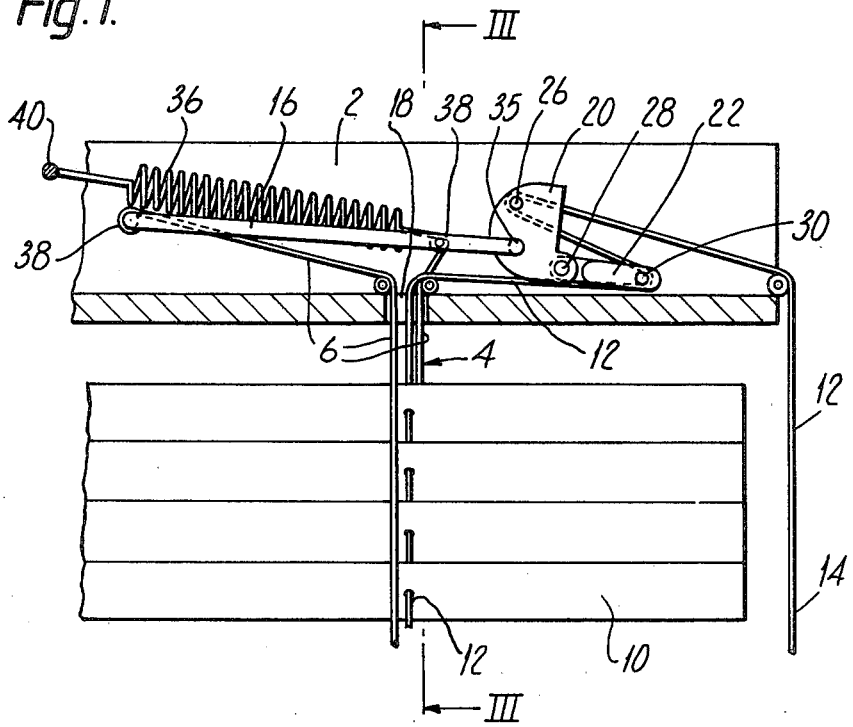

The present invention relates to a Venetian blind of the type comprising a head bar, ladders each comprising two vertical cords, slats supported by the ladders between said cords substantially parallel with said head bar and an operating device for displacing the vertical cords of each ladder in relation to each other in parallel and opposite directions in order to provide a tilting of the slats.

In a previously known Venetian blind of this type the operating device comprises an operating element connected with the cords of the ladder and displacable in the longitudinal direction of the head bar, the displacement of the cords in relation to each other for providing the tilting of the slats being obtained by displacement of the operating element in the longitudinal direction of the head bar.

Because of said design of the operating device a Venetian blind of this kind can be provided with a large number of different operating functions. However, it is a drawback of the previously known Venetian blind of this type that it includes a complicated and sensitive device for providing the required displacement of the operating element.

The object of the present invention is to provide an improved Venetian blind of the type described above.

In order to comply with this object the operating device of the Venetian blind according to the present invention comprises a linkage, which is connected between the head bar and the operating element and is pivotable for providing the displacement of the operating element between a first position in which the slats are tilted in a first direction and a second position in which the slats are tilted in a second direction.

In a preferred embodiment of the invention the Venetian blind comprises a lift cord, by means of which the slats can be raised and lowered, and the lift cord is connected with the linkage to provide the displacement of the operating element in the head bar, which is necessary to provide the tilting of the slats. Thereby the tilting of the linkage is preferably provided by the fact that the lift cord extends around a surface of the linkage, so that the linkage is pivoted from a first to a second position when the lift cord is drawn and by the fact that the linkage is subjected to the action of a spring which is connected with the linkage or the operating element and is acting for returning the linkage from said second to said first position. By fixing the lift cord in any intermediate position it is of course possible to position the linkage and thereby the operating element and the slats in any desired intermediate position.

In a venetian blind according to the invention, it is possible to provide the tilting of the slats as well as the raising and lowering of the slats by means of the same lift cord. By providing a suitable friction between the lift cord and the surface of the linkage engaged by the cord it is possible to position the slats in any desired tilting position at any desired height position of the slats.

Figure 2:
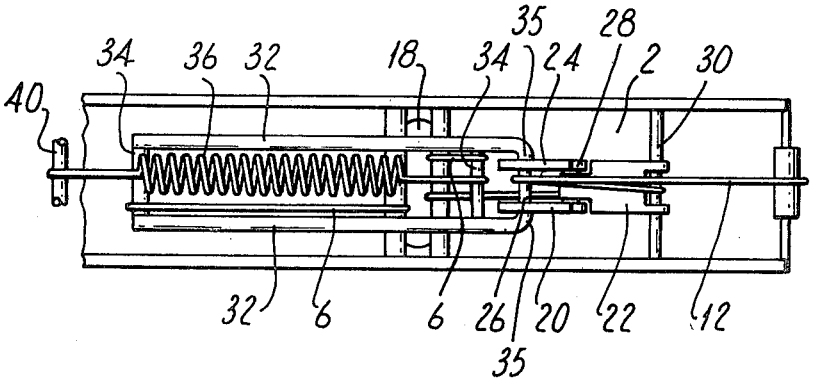
Figure 3:
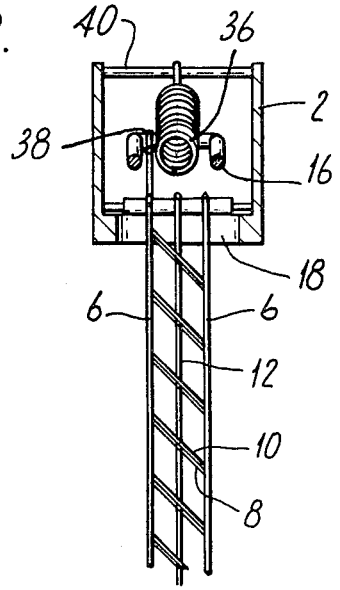
Figure 4:
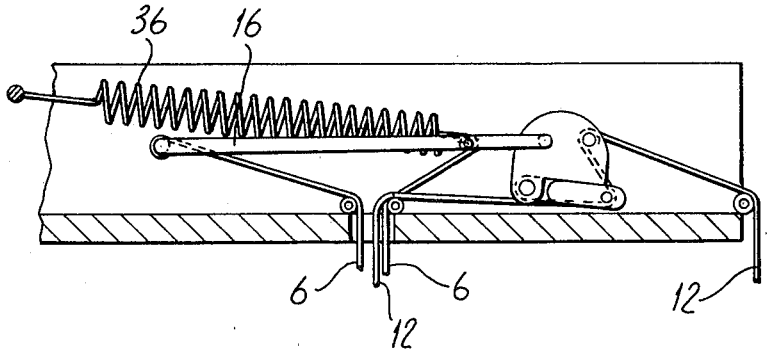

In order that the invention may be more clearly understood, reference will now be made to the accompanying drawings, in which:

FIG. 1 is a portion of a front view of a Venetian blind according to the invention, FIG. 2 is a top plan view of the portion of the Venetian blind of FIG. 1, FIG. 3 is an end view of the portion of the Venetian blind according to FIGS. 1 and 2, and FIGS. 4 and 5 are end views of the portion of the Venetian blind of FIGS. 1–3 in other positions of the parts thereof.

The drawings show a portion of a Venetian blind according to the invention, the drawings especially showing the operating device of the Venetian blind. It is recognized that a Venetian blind according to the invention normally comprises two operating devices of the kind shown in the drawings.

The Venetian blind according to the invention comprises a head bar 2, which is intended to be fixed at the top of a window frame in a conventional way. The Venetian blind comprises a ladder 4 consisting of two vertical cords 6 and cross portions 8 extending between the vertical cords 6 and supporting the slats 10 of the Venetian blind. The Venetian blind also comprises a lift cord 12 which has an accessable portion 14, extends into the head bar 2 and extends through central openings formed in the slats to a bottom cross bar positioned below the slats, whereby it is possible to position the slats so that they cover the window opening, are completely raised to the upper section of the window opening or take any intermediate position by pulling the portion 14 of the lift cord 12.

The tilting of the slats, i.e. the determination of the tilting position of each slat, is provided by longitudinally displacing the cords 6 in relation to each other. In the Venetian blind according to the invention the displacement of the cords for tilting the slats is provided by means of an operating device, which comprises an operating element 16 positioned above an opening 18 in the head bar 2, the operating element 16 being displacable in its longitudinal direction above the opening 18. The operating device also comprises a linkage comprising two link elements 20 and 22, the link element 20 being pivotably connected with the operating element 16 and with the other link element 22 and the other link element 22 being pivotably connected with the link element 20 and with the head bar 2. The link element 20 consists of two side portions 24, a pin 26 and a pivot pin 28, said pins extending between said side portions. The pivot pin 28 provides for a pivotable connection of the link element 20 with the link element 22 which is designed as a plate. The link element 22 is pivotably connected with the head bar 2 by means of a pin 30 fixed to the head bar.

The operating element 16 consists of two bar elements 32 between which connector pins 34 extend. The bar elements 32 are pivotably connected with the side portions 24 of the link element 20 by means of bent portions 35.

The operating element 16 is loaded by means of a tension spring 36 extending between a connector pin 34 in the head bar 2 and a fixed pin 40.

The cords 6 of the ladder 4 are connected with the connector pin 34 of the operating element 16. In the embodiment shown in the drawings the connection is provided by means of hooks 38 which are connected with the ends of the cords 6 and are hooked on to the connector pins 34. It is recognized that it is possible to connect the cords with the connector pins in any other way.

By displacing the operating element 16 in the longitudinal direction of the head bar 2 it is possible to provide such a displacement of the cords 6 of the ladder 4 in relation to each other that is required for providing a tilting of the slats 10 supported by the ladder. Thus, when the operating element 16 is displaced there is provided a raising of one of the cords and a lowering of the other cord. The displacement of the operating element 16 is controlled by means of the linkage 20, 22, and the operation of the linkage and thereby the displacement of the operating element 16 is provided by means of the lift cord 12. The lift cord 12 extends around the pin 26 of the link element 20 and around the pin 30, so that a pulling of the portion 14 of the lift cord downwardly provides that the link element 20 and 22 are pivoted in a clockwise direction from the position shown in FIG. 1, which provides a displacement of the operating element 16 to the right according to FIG. 1 and a displacement of the cords 6 which in turn provides for a tilting of the slats 10.

In the position shown in FIG. 1 the operating element 16 is positioned in its extreme left position, wherein the slats 10 are in their closed position according to FIG. 3. The Venetian blind takes the position shown in FIGS. 1 and 3, when the slats are completely lowered and no pulling action is exerted in the portion 14 of the lift cord 12. By pulling the portion 14 of the lift cord the slats are tilted to a closed position opposite to the closed position according to FIG. 3, while the slats are still in their completely lowered position, by the fact that the pulling action exerted in the portion 14 of the lift cord provides a pivoting of the link element 20 and 22 from the position shown in FIG. 1 to the position shown in FIG. 5 through the position shown in FIG. 4. Thus, the tilting movement of the slats 10 is provided by the fact that the pivoting of the linkage 20, 22 brings about a displacement of the operating element 16 to the right in the figure and an accompanying displacement of the cords 6. It is realized that it is possible to provide a desired tilting position of the slats in the completely lowered position of the Venetian blind by fixing the portion 14 of the lift cord in any position intermediate the positions shown in FIGS. 1 and 5. Thus, there is in a conventional way fixed any fixing element for the lift cord 12 on the window frame.

Figure 5:
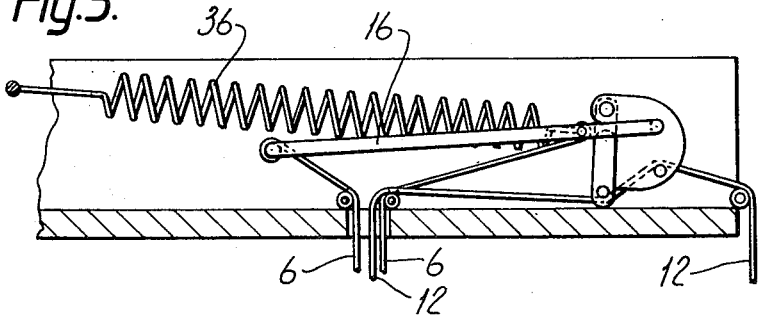

By continuing the pulling of the portion 14 of the lift cord after the linkage 20, 22 has pivoted to the position shown in FIG. 5 and the slats have been closed in the opposite tilting position in relation to the position shown in FIG. 3 provides a raising of the bottom bar of the Venetian blind, whereby it is possible to interupt the raising of the bottom bar when a desired portion of the window opening has been uncovered. When the slats have been raised to the desired position it is possible to position the slats in the desired tilting position by loosening the tensioning of the portion 14 of the lift cord, whereby the operating element 16 is displaced to the left in the figure by the tension spring 36 which is followed by a pivoting of the linkage 20, 22 in the counter clockwise direction. Thereby it is possible to tilt the slats so they more or less approach the position shown in FIG. 3. When the desired tilting position of the slats has been obtained the portion 14 of the cord is fixed. It appears that in a Venetian blind according to the invention it is possible to arrange the Venetian blind in any desired position with regard to the raising of the slats as well as the tilting position of the slats in any desired raising degree.

The fact that the linkage 20, 22 consists of two elements brings about the advantage that the linkage requires less space and does not require more than the normal height of the head bar and also that it is possible to provide a rest position of the linkage corresponding to the position of the slats, wherein the slats take their completely open position. Thus, the linkage has its said rest position in the position according to FIG. 4, wherein the pivoting of the link element 20 has been completed but the pivoting of the link element 22 has not yet been initiated.

It is recognized that a Venetian blind according to the invention preferably comprises two operating devices of the type shown in the drawings, as the slats are preferably supported by two ladders at opposite side portions of the Venetian blind. Therefore, a Venetian blind according to the invention usually has two lift cords which are put together.

Preferably the fixing device for the lift cords is designed so that it is possible to release the lift cords by pressing a button or the like. When the lift cords are released the slats take the position shown in FIGS. 1–3 irrespectively of the previous raising degree or tilting position, whereby it is possible completely to close the Venetian blind in a very rapid and simple way.

I claim:

1. A Venetian blind comprising a head bar, ladders each comprising two vertical cords and cross portions connecting the cords, slats supported by the ladder substantially parallel with the head bar and an operating device for tilting the slats by displacing the vertical cords of each ladder in relation to each other, the operating device comprising an operating element which is displaceable in the longitudinal direction of the head bar and to which the cords of the ladders are connected, the displacement of the cords for providing the tilting of the slats being obtained by the displacement of the operating element in the longitudinal direction of the head bar, characterized in that the operating device comprises a linkage connected between the head bar and the operating element and adapted to pivot to provide for a displacement of the operating element between a first position, wherein the slats are tilted in a first direction, and a second position, wherein the slats are tilted in an opposite direction, and wherein the linkage comprises a first link element which is pivotable in relation to a second link element in that the second link element is pivotable in relation to the head bar.

2. A Venetian blind according to claim 1, characterized in that the operating element engages the first link element which in turn is pivotably connected with the second link element by means of a pivot pin.

3. A Venetian blind according to claim 1 or 3, characterized in that the first link element is adapted to accompany the second link element at the pivotal movement thereof.

4. A Venetian blind according to claim 1, characterized in the pivotal movement of the linkage is divided so that the pivotal movement of the first link element is completed before the pivotal movement of the second link element is initiated.

5. A Venetian blind according to claim 4, characterized in that the slats are in a non-tilted or open position in the position of the linkage, wherein the pivotal movement of the first link element has been completed but before the pivotal movement of the second link element has been initiated.

6. A Venetian blind according to claim 5, comprising a lift cord for raising and lowering the slats of the Venetian blind, characterized in that the lift cord is adapted to provide the pivoting of the linkage and thereby the displacement of the operating element.

7. A Venetian blind according to claim 6, characterized in that the lift cord is connected with the linkage for pivoting the linkage when being subjected to a tensional force and thereby displace the operating element from a first to a second position and that the operating device comprises a spring for returning the linkage and the operating element from said second to said first position.

8. A Venetian blind as claimed in claim 6, characterized in that the lift cord extends around a pin on the first link element, the pin being positioned off-set from the pivotal axis between the first link element and the second link element.

9. A Venetian blind according to claim 8, characterized in that the ends of the vertical cords of the ladders are provided with hooks connected with the operating element.

10. A Venetian blind according to claim 9, characterized in that the operating element is positioned above an opening formed in the head bar, the cords of the ladders being connected with portions of the operating element, which are positioned at opposite sides of the opening.

* * * * *